United States Patent [19]

Basile et al.

[11] 4,216,882

[45] Aug. 12, 1980

[54] BELLOWS NECK SQUEEZE FLUID DISPENSER

[75] Inventors: Peter A. Basile, Hudson; Carl E. Bochmann, Brecksville; Jack Halbeisen, Hudson, all of Ohio

[73] Assignee: The Clorox Company, Oakland, Calif.

[21] Appl. No.: 940,397

[22] Filed: Sep. 8, 1978

[51] Int. Cl.[2] ..... B65D 37/00

[52] U.S. Cl. ..... 222/207; 222/209; 222/214

[58] Field of Search ..... 222/207, 209, 210, 211, 222/214, 383; 417/472, 478–480; 128/230–232, 278, 273; 239/327

[56] References Cited

U.S. PATENT DOCUMENTS

| | | | |
|---|---|---|---|
| 2,849,159 | 8/1958 | Kaufmann | 222/383 |
| 3,162,333 | 12/1964 | Davidson | 222/207 |
| 3,255,933 | 6/1966 | Martin | 222/209 |
| 3,341,083 | 9/1967 | Stewart | 222/209 |
| 3,451,597 | 6/1969 | Watson | 222/207 |
| 3,529,908 | 9/1970 | Smith | 417/472 |

*Primary Examiner*—H. Grant Skaggs
*Attorney, Agent, or Firm*—Phillips, Moore, Weissenberger, Lempio & Majestic

[57] ABSTRACT

A manually actuatable fluid dispenser comprises a plastic bottle container which includes an upstanding bottle neck portion having a flexible bellows formed integrally on one side thereof operable by a reciprocal trigger member which engages the bellows through a trigger spring for exerting a sustained but limited force on the bellows, and reaction force on the trigger member, over extensive trigger actuation travel and speed. The upper end of the cylindrical neck of the container is closed by a dispenser body which includes a fluid passage having a check valve disposed therein for controlling the flow of fluid in the fluid passage. A fluid tube disposed in the bottle neck includes a seal for fluid isolation of the bottle neck from the bottle, and a check valve for allowing flow of fluid from the bottle into the bottle neck.

17 Claims, 3 Drawing Figures

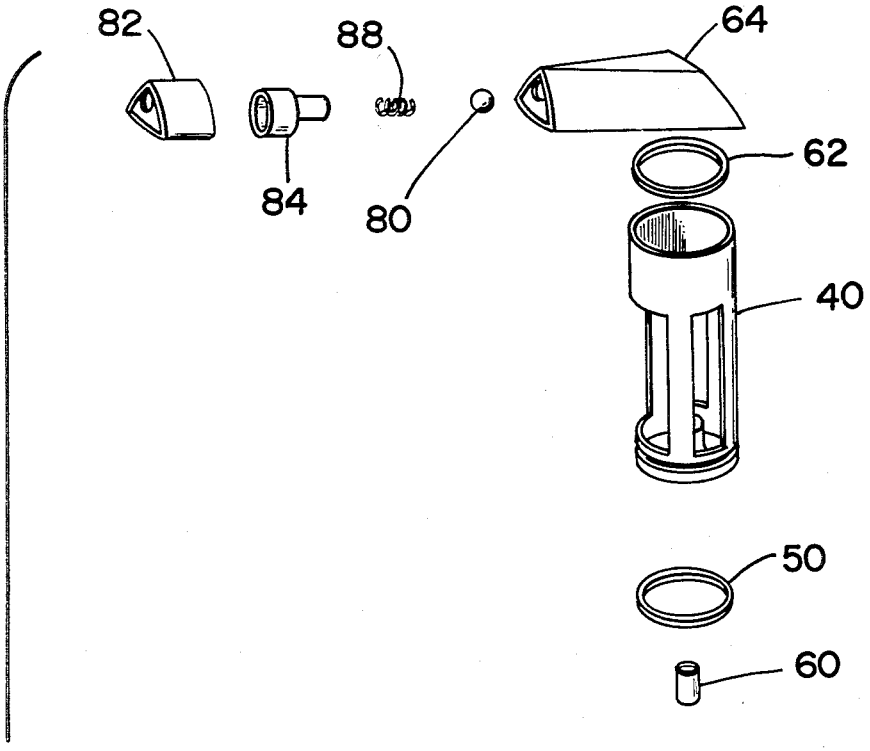
FIG_3
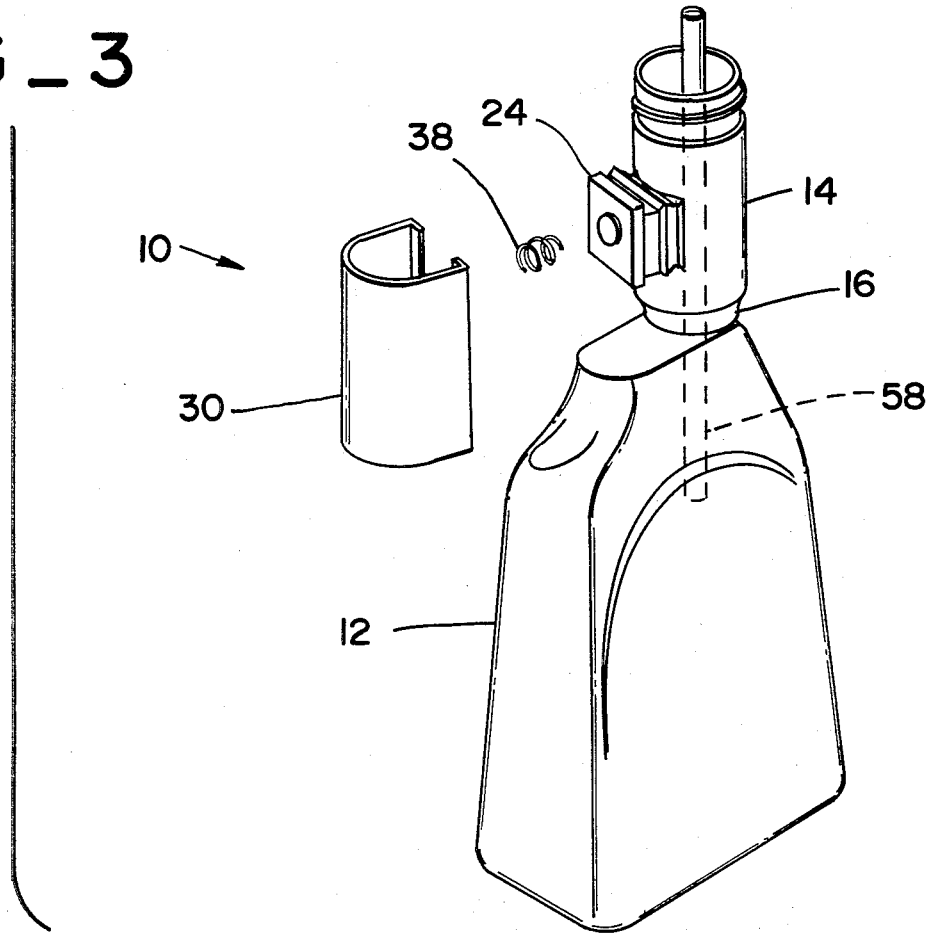

BELLOWS NECK SQUEEZE FLUID DISPENSER

BACKGROUND OF THE INVENTION

This invention relates to the field of manual fluid dispensing systems, and more particularly to fluid dispensers wherein fluid is pumped from a fluid container by squeezing and releasing a flexible portion of the container neck. A number of prior art dispensing systems have been developed wherein a container or bottle includes a neck which includes a flexible member whereby the volume thereof may be varied by actuation of a trigger mechanism which engages the flexible member in the bottle neck. A suitable combination of check valves upstream and downstream of the flexible neck member provides a pumping effect when the flexible neck member, or trigger mechanism engaging such flexible neck member, is alternatively squeezed and released. While such prior art devices are effective to pump pressurized fluid from a container so equipped, they have not only been unduly commplicated in construction, but have been difficult to operate comfortably due to high operating forces and undesirable fluid flow responses yielded by such mechanisms.

SUMMARY OF THE INVENTION

Accordingly, it is an object of the present invention to provide a neck squeeze fluid dispensing system whereby relative large volumes of fluid may be conveniently expelled by relatively few manipulations of the dispenser.

It is another object of the invention to provide a neck squeeze fluid dispenser in which all loads encountered during manual manipulation of the dispenser are maintained below any uncomfortably high forces regardless of the manner in which the neck squeeze mechanism is manipulated.

Still another object of the present invention is to provide a neck squeeze fluid dispensing system in which a strong continuous flow of fluid will be achieved by a relatively slow and infrequent manipulation of the neck squeeze mechanism.

Still another object of the present invention is to provide a neck squeeze fluid dispensing system which is relatively uncomplicated and inexpensive to manufacture and assemble.

Another object of the present invention is to provide a neck squeeze fluid dispenser which is easily refillable.

These and other objects and advantages are achieved by the device of the present invention which provides a dispenser which includes a bottle portion and a cylindrical neck portion which extends above the bottle portion and has a bellows integrally formed in one side thereof. The bottle and neck portions of the container, including the bellows, are integrally formed from one piece of plastic whereby the bellows portion will be deformable due to the inherent flexibility of the plastic in the bellows wall configuration. The upper end of the cylindrical neck portion is closed by a dispenser body which includes fluid passage means, and check valve means disposed in said fluid passage means. A tubular member is disposed within the neck portion of the fluid container and retained therein by the dispenser body, and includes a lower end portion which includes isolation means, including seal means, for isolating the container neck portion from the container body. A check valve disposed in the isolation means of the tubular member controls flow of fluid between the bottle and the neck portion of the bottle. A hand engageable trigger mechanism is slideable on the neck portion of the bottle and engages the neck bellows through a trigger spring whereby the force between the trigger and the bellows will be limited to the force of maximum compression of the spring, and will be sustained over an extended range of trigger compressions by subsequent expansion of the trigger springs and compression of the bellows.

DESCRIPTION OF THE DRAWINGS

In the drawings:

FIG. 3 is an exploded perspective view of the dispenser system of the present invention.

DESCRIPTION OF THE PREFERRED EMBODIMENT

Figures 1, 2:
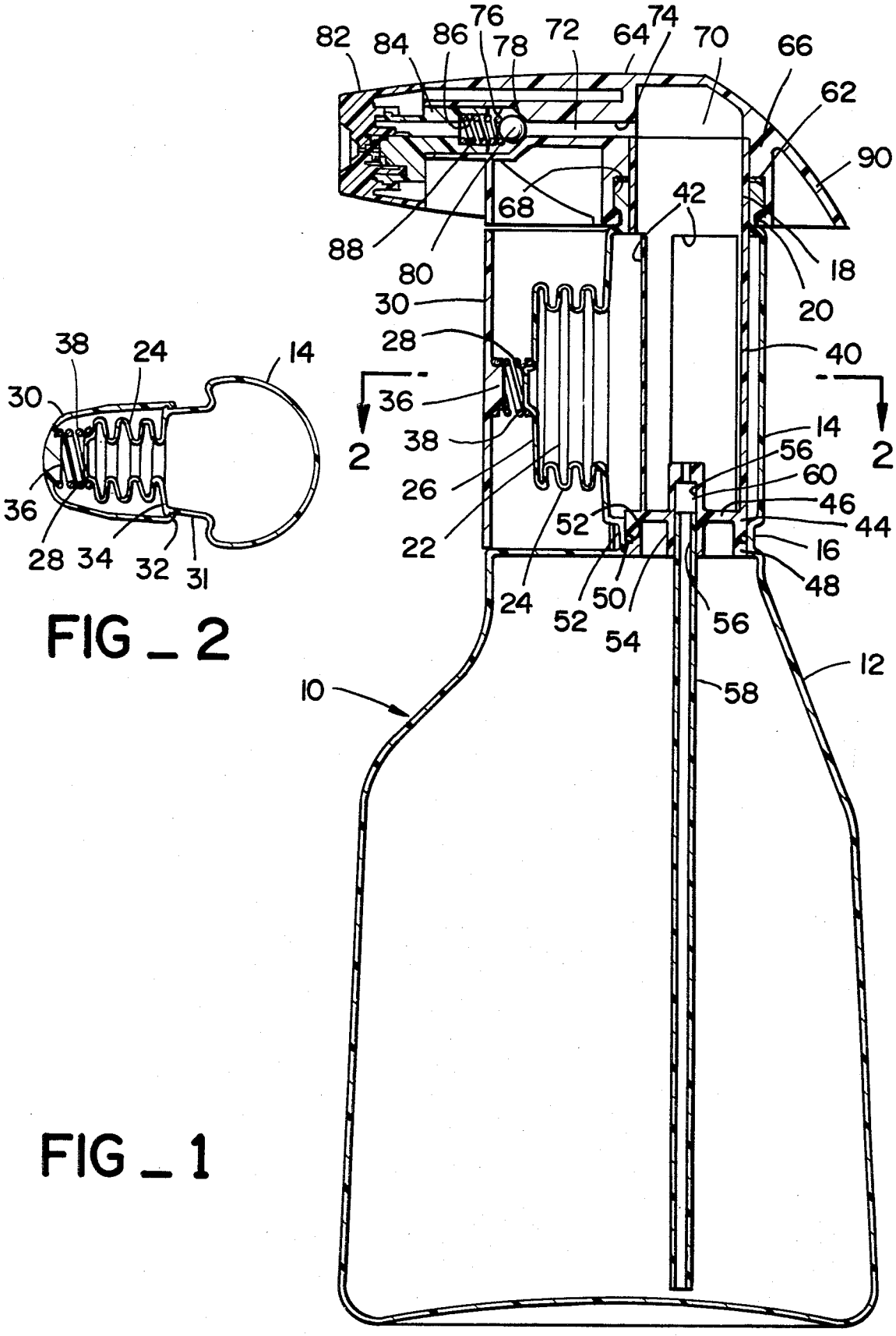
FIG. 1 is a sectional view of a dispenser system embodying the present invention.
FIG. 2 is a sectional view taken along the line 2—2 in FIG. 1.

Referring to FIG. 1, a dispensing system embodying the present invention is shown generally at 10 and includes a bottle 12 and a bottle neck 14 formed integrally therewith and joined to the bottle at a cylindrical restricted portion 16. Bottle neck 14 is of generally cylindrical configuration and extends upwardly above bottle 12 and terminates in a finish 18 having threads 20 provided thereon. Formed integrally on one side of bottle neck 14 is a bellows 22 having accordian-like side walls 24 closed by an end wall 26 which has a raised cylindrical spring retainer 28 formed thereon. The accordian-like configuration of the side walls of the bellows, and the flexibility of the plastic selected to construct the bottle and integral bottle neck and bellows, results in lateral flexibility of the bellows which will result in a change of volume thereof, and of the bottle neck on which it is formed, when lateral forces are imposed on the end wall of the bellows.

A U-shaped trigger member 30 is disposed around the bellows on the front of the bottle neck and is reciprocal on a flat shoulder formed on the bottle adjacent the bottle neck. As shown in FIG. 2, the bottle neck has flats 31 formed at each side of the neck. Trigger 30 has rear edges which are provided with inwardly directed lips 32 which slide on flats 31 and are arranged to engage ridges 34 provided for limiting sliding of the trigger on the bottle neck.

A cylindrical spring retainer 36 is provided on the inner front surface of the trigger in alignment with spring retainer 28 on the end wall of the bellows for retention of a trigger spring 38 therebetween.

A fluid tube comprising a cylindrical member 40 having openings 42 provided in the wall thereof is disposed within bottle neck 14 and includes a lower end 44 closed by an end wall 46 having a depending annular skirt 48 provided around the periphery thereof. Skirt 48 is arranged to fit closely within restricted portion 16 of bottle neck 14 at the juncture of bottle 12 and bottle neck 14, and has an annular groove 50 in which is disposed a circular seal 52 for sealing engagement of the skirt with the restricted portion 16 of the bottle neck.

Disposed in end wall 46 is a tube 54 whose lower portion is provided with an internal bore 56 into which is fitted the upper end of a dip tube 58. Disposed in tube 54 above dip tube 58 is a duck bill check valve 60 which opens upwardly into the interior of fluid tube 40 and bottle neck 14.

The upper end of fluid tube 40 is provided with an annular flange 62 arranged to engage the top surface of finish 18 for retaining the fluid tube in the bottle neck whereby seal 52 will engage restricted portion 16.

A dispenser body 64 is disposed on bottle neck 14 by means of a cap portion 66 provided with internal thread 68 arranged to threadably engage finish 18 in sealing relationship therewith. Cap portion 66 forms a fluid chamber 70 which communicates with a horizontal fluid discharge passage 72 formed by a first inner bore 74 and a larger outer bore 76 which is joined with inner bore 72 by a conical surface which forms a valve seat 78 for a balltype check valve 80 disposed in outer bore 76. A spray nozzle assembly 82 is secured to the dispenser body by means of a tubular member 84 which is pressed into the outer end of outer bore 76. The end of tubular member 84 includes an internal bore 86 which forms a retainer seat for a spring 88 which biases check valve 80 against valve seat 78. A tab 90 extends rearwardly from the dispenser body for resting of the dispenser and bottle coupled thereto on the top of the hand.

The fluid dispenser disclosed may be easily and comfortably gripped at the bottle neck 14 by one hand whereby tab 90 will rest upon the top of the hand at the base of the thumb to support the weight of the fluid dispenser on the hand without a requirement for tightly gripping the bottle neck. The fingers of the hand gripping the bottle neck will wrap naturally around trigger 30 for easy actuation thereof.

In operation, fluid may be dispensed from bottle 12 through spray nozzle 82 by manually squeezing the bottle neck and trigger whereby the trigger will slide toward bottle neck 14, exerting a force through trigger spring 38 on bellows 22, collapsing the bellows and decreasing the volume of the bottle neck 14. Fluid in bottle neck 14 will be prevented from re-entering bottle 12 by check valve 60, and will be discharged through fluid discharge passage 72, past check valve 80, which will open against spring 88 when fluid pressure in passage 72 reaches a pre-selected level. Since trigger 30 is coupled to bellows 22 through spring 38, the reaction force exerted by the bellows on the trigger during compression thereof will be modulated by the compressability of the spring and limited to the spring force exerted at maximum compression thereof. In addition to limiting the reaction forces on the trigger, the spring coupling of the trigger to the bellows also provides for a sustained pumping of fluid from the bottle neck by collapsing of the bellows under the force exerted by compressed spring 38 after inward travel of the trigger terminates, and thus the volume of fluid that can be expelled with each operation of the trigger is large. It will further be appreciated that since the cross section of the bellows is constant, and will remain constant as the bellows is compressed, the change of volume of the bellows will be linear with respect to displacement of the bellows end wall, and thus the pressure of fluid disposed in the bottle neck will be constant. It will further be appreciated that the end wall of the bellows may be displaced at significant distance laterally, and yield a significant and extensive change in volume of the bellows and the bottle neck for expelling a volume of fluid from the bottle neck comparable to the volume of the bellows in the uncompressed mode. Accordingly, the dispenser of the present invention does not require numerous or rapid operation thereof to achieve a high fluid discharge rate.

What is claimed is:

1. A manually operable fluid dispenser comprising:

a plastic bottle including a bottle neck formed integrally thereon, a bellows formed integrally on a side of said bottle neck, said bellows formed by accordion-like sidewalls extending outwardly from said side of said bottle neck, and an end wall secured to and enclosing the sidewalls, whereby upon application of a force to the end wall the sidewalls of the bellows will fold to allow collapsing thereof to provide a linear change in volume in the bellows as the end wall is moved, isolation means for isolating fluid in the bottle neck from the bottle, said isolation means including a first check valve for allowing fluid to flow from the bottle to the bottle neck, a trigger disposed on the bottle of a construction sufficient for manual actuation of the bellows by inward travel of said trigger towards said bellows, spring coupling means for sustaining pumping of fluid from said bottle neck by permitting continued collapsing of said bellows after inward travel of said trigger terminates, a dispenser body mounted on said bottle neck in fluid communication therewith, said dispenser body including means forming a fluid discharge passage, and a second valve for controlling flow of fluid through the fluid discharge passage.

2. The dispenser defined in claim 1 wherein said isolation means comprises a member disposed in the bottle neck and closing the bottle neck at a juncture portion between the bottle neck and the bottle, wherein the first check valve is disposed in said member.

3. The dispenser defined in claim 2 wherein the member is removable from the bottle neck and includes circumferential seal means for sealing engagement of said member with the bottle neck.

4. The dispenser defined in claim 3 wherein the isolation means includes an outstanding portion which extends upwardly through the bottle neck and has an annular flange adapted to rest against the juncture portion of the bottle neck with the bottle whereby the seal means will be disposed in sealing communication with the juncture portion of the bottle neck.

5. The dispenser defined in claim 3 wherein said isolation means includes a tubular member extending therethrough and wherein the first check valve is disposed in the upper portion of the tubular member, and further comprising a dip tube disposed in a lower portion of the tubular member whereby the first check valve is retained in the tubular member and fluid is communicated thereto from the bottle through said dip tube.

6. The dispenser defined in claim 1 wherein the trigger is connected to and engages the end wall of the bellows through said spring coupling means, and said spring coupling means is also for limiting reaction forces between the trigger and the bellows.

7. The dispenser defined in claim 6 wherein the bottle includes a flat shoulder adjacent the bottle neck, and wherein the trigger slides on said flat shoulder.

8. The dispenser defined in claim 7 wherein the bottle neck includes flats provided thereon, and ridges at the sides of said flats, said spring coupling means is a trigger spring, and wherein the trigger is slidable on the bottle and comprises a U-shaped member having a center portion engaging the trigger spring and side portions that extend past the bellows and terminate in edges which slide on the flats.

9. The dispenser defined in claim 8 wherein the flats and ridges are formed integrally on the bottle neck, and wherein the trigger further comprises lips on the edges thereof that engage the flats, said lips being arranged to slide on the flats and engaging the ridges formed at the sides thereof, to limit sliding of the trigger on the bottle neck.

10. The dispenser defined in claim 9 wherein said bottle neck includes a threaded finish at its upper end and said dispenser body includes a cap portion which is engaged with the finish, and wherein said dispenser body vertically retains the isolation means in the bottle neck, and the trigger on the bottle neck.

11. A manually operable fluid dispenser comprising:

a bottle, a bottle neck formed integrally with bottle and upstanding therefrom, a bellows formed integrally on one side of the bottle neck, isolation means disposed in the bottle neck for isolating fluid in the bottle neck from fluid in the bottle, a first check valve disposed in the isolation means for communicating fluid in the bottle to the bottle neck, a trigger slidably disposed on said bottle and bottle neck, a trigger spring disposed between the trigger and the bellows whereby upon sliding of the trigger on the bottle neck the spring will be compressed and exert a force on the bellows, a dispenser body coupled to the bottle neck and retaining the isolation means in the bottle neck and the trigger on the bottle neck, said dispenser body including fluid discharge passage means for discharging pressurized fluid from the bottle neck, and a second check valve disposed in the fluid discharge passage means.

12. In a manually operable fluid dispenser having a bottle portion adapted to contain liquid, a neck portion, a dispenser body being mounted on the neck portion in fluid communication therewith, means for isolating fluid in the neck portion from the bottle portion, and means for allowing fluid to flow from the bottle portion to the neck portion, an improvement comprising:

a pair of flats formed upon said neck portion;

a flexible wall formed on a side of said neck portion between said flats; and, pump means for pumping fluid from said neck portion to said dispenser body by collapsing of said flexible wall, said pump means including a curved trigger mounted on said bottle neck and slidable on said flats inwardly toward said flexible wall to partially collapse said flexible wall and spring coupling means for coupling said trigger with said flexible wall and for permitting continued collapsing of said flexible wall.

13. The improvement defined in claim 12 wherein the neck portion includes ridges interposed between said flexible wall and each of said flats, and wherein the trigger includes a U-shaped member having a center portion engaging the spring coupling means and side portions that extend past the flexible wall and terminate in edges which slide on the flats.

14. The improvement defined in claim 13 wherein the flats and ridges are formed integrally on the neck portion, and wherein the trigger further comprises lips on the edges thereof that engage the flats, said lips being arranged to slide on the flats and engaging the ridges formed at the sides thereof, to limit sliding of the trigger on the neck portion.

15. The improvement defined in claim 14 wherein said neck portion has an upper end with a threaded finish and said dispenser body includes a cap portion engaged with said finish.

16. The improvement defined in claim 15 wherein said flexible wall forms a bellows having accordian-like side walls extending outwardly from said neck portion, and an end wall closing said side walls, whereas as the end wall is moved the volumn of the bellows will change linearly, and wherein the spring coupling means engages the end wall of the bellows.

17. The invention defined in claim 16 wherein said end wall includes means therein forming a spring retainer.

* * * * *